US010563390B2

(12) United States Patent
Schwab

(10) Patent No.: US 10,563,390 B2
(45) Date of Patent: Feb. 18, 2020

(54) WASH AND CLEAN APPARATUS

(71) Applicant: Whole Bath, LLC, East Chatham, NY (US)

(72) Inventor: Brian Schwab, East Chatham, NY (US)

(73) Assignee: Whole Bath, LLC, East Chatham, NY (US)

( * ) Notice: Subject to any disclaimer, the term of this patent is extended or adjusted under 35 U.S.C. 154(b) by 0 days.

(21) Appl. No.: 15/847,594

(22) Filed: Dec. 19, 2017

(65) Prior Publication Data

US 2019/0186116 A1 Jun. 20, 2019

(51) Int. Cl.

| | |
|---|---|
| ***E03D 9/08*** | (2006.01) |
| ***B05B 12/00*** | (2018.01) |
| ***B05B 1/02*** | (2006.01) |
| ***B05B 15/62*** | (2018.01) |

(52) U.S. Cl.

CPC ..... *E03D 9/08* (2013.01); *B05B 1/02* (2013.01); *B05B 12/002* (2013.01); *B05B 15/62* (2018.02)

(58) Field of Classification Search

CPC .. E03D 9/08; B05B 15/62; B05B 1/02; B05B 12/002

USPC ..... 4/443, 447, 448

See application file for complete search history.

(56) References Cited

U.S. PATENT DOCUMENTS

| | | | |
|---|---|---|---|
| 2,875,450 | A | 3/1959 | Umann |
| D198,085 | S | 4/1964 | Rich |
| 3,810,260 | A | 5/1974 | Lodi |
| 3,995,326 | A | 12/1976 | Umann |
| 4,279,362 | A | 7/1981 | Pursell |
| 4,287,618 | A | 9/1981 | Silver |
| 4,327,560 | A | 5/1982 | Leon |
| D266,758 | S | 11/1982 | Johannsen |
| 4,422,189 | A | 12/1983 | Couvrette |
| D279,184 | S | 6/1985 | Sakamoto |
| 4,628,548 | A | 12/1986 | Kurosawa |
| D303,966 | S | 10/1989 | Fritzsche |
| 4,903,347 | A | 2/1990 | Garcia |
| 4,987,617 | A | 1/1991 | Furukawa |
| 5,031,252 | A | 7/1991 | Oyama |

(Continued)

FOREIGN PATENT DOCUMENTS

| | | |
|---|---|---|
| EM | 025022450001 | 7/2014 |
| EP | 2138640 | 12/2009 |

(Continued)

OTHER PUBLICATIONS

Final Office Action for U.S. Appl. No. 15/588,640 dated Dec. 3, 2018.

(Continued)

*Primary Examiner* — Tuan N Nguyen

(74) *Attorney, Agent, or Firm* — Fitch, Even, Tabin & Flannery LLP

(57) ABSTRACT

A method and apparatus are provided for washing and cleaning a region of a human body, where the apparatus is easy to carry, easily connected to auxiliary parts, and easy to install and use the various functions thereof. The apparatus includes a support body, an extended element connected to the support body, a lip element connected to the extended element, and a spray wand assembly connected to the lip element and adapted to deliver liquid with one or more liquid channels therein, wherein the spray wand assembly, includes a distal end element.

20 Claims, 5 Drawing Sheets

(56) References Cited

U.S. PATENT DOCUMENTS 5,101,520 A 4/1992 Lockhart
5,201,080 A 4/1993 Tanaka
5,203,037 A 4/1993 Kang
5,247,711 A 9/1993 Kwon
5,335,855 A 8/1994 Borod
D355,246 S 2/1995 Kawamura
5,409,167 A 4/1995 Borod
D367,922 S 3/1996 Kobayashi
5,504,948 A 4/1996 Chandler
5,551,098 A 9/1996 Wilk
5,566,402 A 10/1996 Agha El-Rifai
5,630,234 A 5/1997 Childs
D387,851 S 12/1997 Pieters
5,720,054 A 2/1998 Nakayama
5,765,238 A 6/1998 Furukawa
5,813,060 A 9/1998 Klopocinski
5,864,894 A 2/1999 Fedele
5,898,956 A 5/1999 Kurisaki
5,911,516 A 6/1999 Chang
5,953,765 A 9/1999 Hayashi
5,987,659 A 11/1999 Cannizzaro
6,003,159 A 12/1999 Sadegh
6,009,570 A 1/2000 Hargest
D423,655 S 4/2000 Otte
6,073,275 A 6/2000 Klopocinski
6,105,178 A 8/2000 Kurisaki
D432,220 S 10/2000 Hulsebus
6,128,788 A 10/2000 Yamazaki
D435,638 S 12/2000 Merry
6,167,577 B1 1/2001 Hammad
6,178,568 B1 1/2001 Boulieris
6,192,527 B1 2/2001 Paul
D451,076 S 11/2001 Sommer
D451,177 S 11/2001 Scholpp
6,339,852 B1 1/2002 Huang
6,397,406 B1 6/2002 Moshkovich
6,449,780 B1 9/2002 Merry
6,481,590 B1 11/2002 Simkins
D471,966 S 3/2003 Takahashi
D481,016 S 10/2003 Hillis
D485,337 S 1/2004 Tani
6,688,500 B1 2/2004 Cheng
6,754,912 B1 6/2004 Hayashi
D500,130 S 12/2004 Jung
D508,733 S 8/2005 Peng
D512,425 S 12/2005 Nakagawa
6,973,679 B1 12/2005 Schad
7,096,518 B2 8/2006 Takenaga
D528,991 S 9/2006 Katsuyama
7,120,946 B1 10/2006 Lazar
7,127,750 B2 10/2006 Lim
D533,788 S 12/2006 Kleiman
7,155,755 B2 1/2007 Olivier
D538,907 S 3/2007 Kaule
7,191,473 B2 3/2007 Matsumoto
D541,225 S 4/2007 Katsuyama
7,216,374 B2 5/2007 Hassan
7,284,285 B2 10/2007 Scalzi
7,287,286 B2 10/2007 Lee
D554,613 S 11/2007 Nakatani
D558,181 S 12/2007 Takada
D564,976 S 3/2008 Jackson
D565,554 S 4/2008 Fan
D578,515 S 10/2008 Ikeda et al.
D579,342 S 10/2008 Priestman
D583,030 S 12/2008 Kobayashi
D594,537 S 6/2009 Driedger
D594,945 S 6/2009 Nakasaki et al.
7,543,339 B1 6/2009 Harris
D608,426 S 1/2010 Watanabe
D616,445 S 5/2010 Wong et al.
D634,735 S 3/2011 Maier
D639,399 S 6/2011 Takeuchi
D639,400 S 6/2011 Kang
7,954,181 B2 6/2011 Lim
8,060,953 B1 11/2011 Dorra
D654,808 S 2/2012 Gidlow
8,161,580 B2 4/2012 Hashidume
8,261,377 B2 9/2012 Oh
D668,642 S 10/2012 Feldman et al.
8,291,527 B2 10/2012 Pan
D670,659 S 11/2012 Yoshioka
D671,935 S 12/2012 Mao
8,365,317 B1 2/2013 Dorra
8,425,475 B2 * 4/2013 Sodo ..... A61M 3/0225 4/443
D682,246 S 5/2013 Boqueho
D688,359 S 8/2013 Ogata et al.
D692,417 S 10/2013 Tu
D692,541 S 10/2013 Hosoi et al.
D698,754 S 2/2014 Vignau-Lous
D703,797 S 4/2014 Shinozaki
D704,316 S 5/2014 Yoshioka
D704,317 S 5/2014 Ando
D706,402 S 6/2014 Yeung
D708,954 S 7/2014 Barnes
8,776,278 B1 7/2014 Dorra
D713,815 S 9/2014 Ookawa
D715,774 S 10/2014 Lee et al.
D716,768 S 11/2014 Kim
D717,930 S 11/2014 Kergoet
8,904,575 B1 12/2014 Lindheimer
D724,058 S 3/2015 Chandel
D724,059 S 3/2015 Kim
D750,765 S 3/2016 Giametta
9,273,454 B2 3/2016 Slawinski
9,279,241 B2 3/2016 Morioka
D753,095 S 4/2016 Moran
9,464,425 B2 * 10/2016 Bailey ..... E03D 9/08
D781,808 S 3/2017 Pista
D792,867 S 7/2017 Murphy
D805,615 S 12/2017 Peng
9,889,982 B2 2/2018 Falcon
2003/0140407 A1 7/2003 Matsumoto
2004/0055080 A1 3/2004 Marshall
2005/0000006 A1 1/2005 Takenaga
2005/0010997 A1 1/2005 Olivier
2006/0000012 A1 1/2006 Schad
2006/0047055 A1 3/2006 Agostini
2006/0265801 A1 11/2006 Riccobon
2007/0241929 A1 10/2007 Marchetto
2008/0055394 A1 3/2008 Shiue
2008/0201837 A1 8/2008 Oh
2008/0251551 A1 10/2008 Huber
2009/0313752 A1 12/2009 Kunimoto
2010/0012685 A1 1/2010 Ramsey
2010/0152475 A1 6/2010 Raichle
2010/0176224 A1 7/2010 Hasselschwert
2011/0132929 A1 6/2011 Bennett
2011/0191950 A1 8/2011 Liu
2011/0203044 A1 8/2011 Lim
2012/0005817 A1 1/2012 Jeong
2012/0011647 A1 1/2012 Mochita
2012/0150148 A1 6/2012 Shi
2012/0180785 A1 7/2012 Trill
2012/0266483 A1 10/2012 Palermo
2013/0133131 A1 5/2013 Peng
2013/0180041 A1 7/2013 Ding
2013/0267890 A1 10/2013 Li
2014/0042195 A1 2/2014 Geis
2014/0047626 A1 2/2014 Dorra
2014/0068862 A1 3/2014 Al-Jafar
2014/0107409 A1 4/2014 Bailey
2015/0000025 A1 1/2015 Clements
2015/0059076 A1 3/2015 Tiagai
2015/0203279 A1 7/2015 Falcon
2015/0225167 A1 8/2015 Andersen
2015/0337525 A1 11/2015 Bailey
2016/0316978 A1 11/2016 Peng
2017/0021116 A1 1/2017 Rahmel
2017/0101838 A1 4/2017 Razvi
2017/0142306 A1 5/2017 Peng
2017/0265624 A1 9/2017 Wilson
2017/0319794 A1 11/2017 Schwab

(56) References Cited

U.S. PATENT DOCUMENTS

| | | | | |
|---|---|---|---|---|
| 2017/0321406 | A1 | 11/2017 | Schwab | |
| 2017/0321407 | A1 | 11/2017 | Schwab | |
| 2017/0321408 | A1 | 11/2017 | Schwab | |
| 2018/0015238 | A1 | 1/2018 | Schwab | |
| 2018/0028797 | A1 | 2/2018 | Schwab | |
| 2018/0036473 | A1 | 2/2018 | Schwab | |
| 2018/0044903 | A1* | 2/2018 | Schwab | ..... E03D 9/08 |

FOREIGN PATENT DOCUMENTS

| | | |
|---|---|---|
| IN | 2689190001 | 10/2015 |
| JP | H0893034 | 4/1996 |
| JP | H0988165 | 3/1997 |
| JP | H1163666 | 3/1999 |
| JP | 2001279778 | 10/2001 |
| WO | 2008024005 | 2/2008 |
| WO | 2013020240 | 2/2013 |
| WO | 2012044086 | 4/2017 |

OTHER PUBLICATIONS

Kohler, Self-Cleaning Wand, https://www.youtube.com/watch?v=z629hpdnWj8, published Oct. 12, 2016.

PCT Notification of Transmittal of The International Search Report and The Written Opinion of The International Searching Authority, or Declaration, PCT/US2017/031482, filed on May 6, 2017 by Whole Bath, LLC.

PCT Notification of Transmittal of The International Search Report and The Written Opinion of The International Searching Authority, or Declaration, PCT/US2017/031483, filed on May 6, 2017 by Whole Bath, LLC.

PCT Notification of Transmittal of The International Search Report and The Written Opinion of The International Searching Authority, or Declaration; PCT/US2017/031484, filed on May 6, 2017 by Whole Bath, LLC.

PCT Notification of Transmittal of The International Search Report and The Written Opinion of The International Searching Authority, or Declaration; PCT/US2017/031485, filed on May 6, 2017 by Whole Bath, LLC.

PCT Notification of Transmittal of The International Search Report and The Written Opinion of The International Searching Authority, PCT/2017/031484, dated Aug. 14, 2017.

PCT Notification of Transmittal of The International Search Report and The Written Opinion of The International Searching Authority, PCT/US2016/45932, dated Oct. 24, 2016.

PCT Notification of Transmittal of The International Search Report and The Written Opinion of The International Searching Authority, PCT/US2017/042288, dated Sep. 28, 2017.

PCT Notification of Transmittal of The International Search Report and The Written Opinion of The International Searching Authority, PCT/US2017/42253, dated Nov. 21, 2017.

Schwabcare website 2017, http://schwabcare.com/, site visited Jan. 21, 2018.

* cited by examiner

WASH AND CLEAN APPARATUS

BACKGROUND OF THE INVENTION

Embodiments of the present invention generally relate to apparatus for washing and cleaning a region of a human body. More specifically, aspects of the present invention provide a method and apparatus for delivering and applying water, medication, and/or a cleaning solution to a region of the body (e.g., genital or anal area, intimate parts, perianal region) which may be difficult for the user to access

DESCRIPTION OF THE RELATED ART

Bidets and other modern toilet seat systems have been used to spray water and clean private parts of a user using a toilet. The bidet systems are used for washing the genital and anal areas using cleaning water of appropriate temperature sprayed from the center of the bidet system, instead of a toilet paper after relief of stool or urination. Originally being developed for washing the pubic area for females, bidet systems have now become popular among people of all ages and both sexes because it is known to be more hygienic to wash the intimate parts and anus with water instead of paper after relief. In addition, cleansing the pubic/anal regions with water may help to avoid infection and prevent hemorrhoids and other anal disease. Furthermore, it is very effective for women with gynecology diseases. It is also very useful for the elderly or obese people to relieve themselves with great convenience.

However, most bidets and bidet seat cleaning systems have water spray nozzle located or positioned near the posterior or anal area and thus not suitable for washing and cleaning female anterior private parts. In addition, bidet systems are expensive and need to be pre-installed. Further, many public restrooms do not have and may not have such water spray bidet systems. Therefore, there is a need for a convenient, easy-to-carry wash and clean apparatus for cleaning genital or anal area of a human body.

SUMMARY OF THE INVENTION

The present invention generally includes a small-scale apparatus for washing and cleaning the genital and anal area of a human body. An apparatus and method of using the apparatus are provided for washing and cleaning a region of a human body that is easy-to-carry, easily connected to auxiliary parts, and that is easy to install and use the functions thereof.

In one embodiment, the wash and clean apparatus generally includes a support body, an extended element connected to the support body, a lip element connected to the extended element, and a spray wand assembly connected to the lip element and adapted to deliver liquids with one or more liquid channels therein, wherein the spray wand assembly, includes a distal end element where a spray opening is located. In another embodiment, the spray wand assembly of the apparatus is adapted to deliver liquids flowing therein to be sprayed out, via the spray opening, and onto a desirable area (e.g., a genital area) of a human body.

In a further embodiment, the spray wand assembly of the apparatus includes an arm element and a connector, where the connector is adapted to rotate the arm element such that the spray opening on the distant end element can be flexibly adjusted to be close to a desirable area. In one aspect, the spray wand assembly further includes a rod element, where the connector is adapted to connect the rod element and the arm element. In another aspect, the arm element of the spray wand assembly is connected to the distal end element.

In addition, the wash and clean apparatus may further include a power switch, a power indicator for powering up the apparatus and operating the wash, clean and other functions of the apparatus. In one aspect, the apparatus is connected to a power cord. In another aspect, the apparatus is connected to a battery power pack.

In still another embodiment, the support body of the apparatus is connected to a canister assembly, which may include medication and/or cleaner solutions therein. In yet another embodiment, the support body of the apparatus includes a water inlet adapted to be connected to a water hose assembly for supplying water and other liquid into the wash and clean apparatus.

In one aspect, the extended element of the apparatus includes a lever. In another aspect, the extended element of the apparatus includes a suction cup assembly therein. The lever and the suction cup assembly are designed so as to allow the wash and clean apparatus to be easily placed and secured onto a toilet.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention includes an apparatus for providing easy washing and cleaning of a person's bottom while using a toilet. The apparatus can be placed directly over a rim of a toilet bowl or a seat of a toilet seat system.

Figure 1:
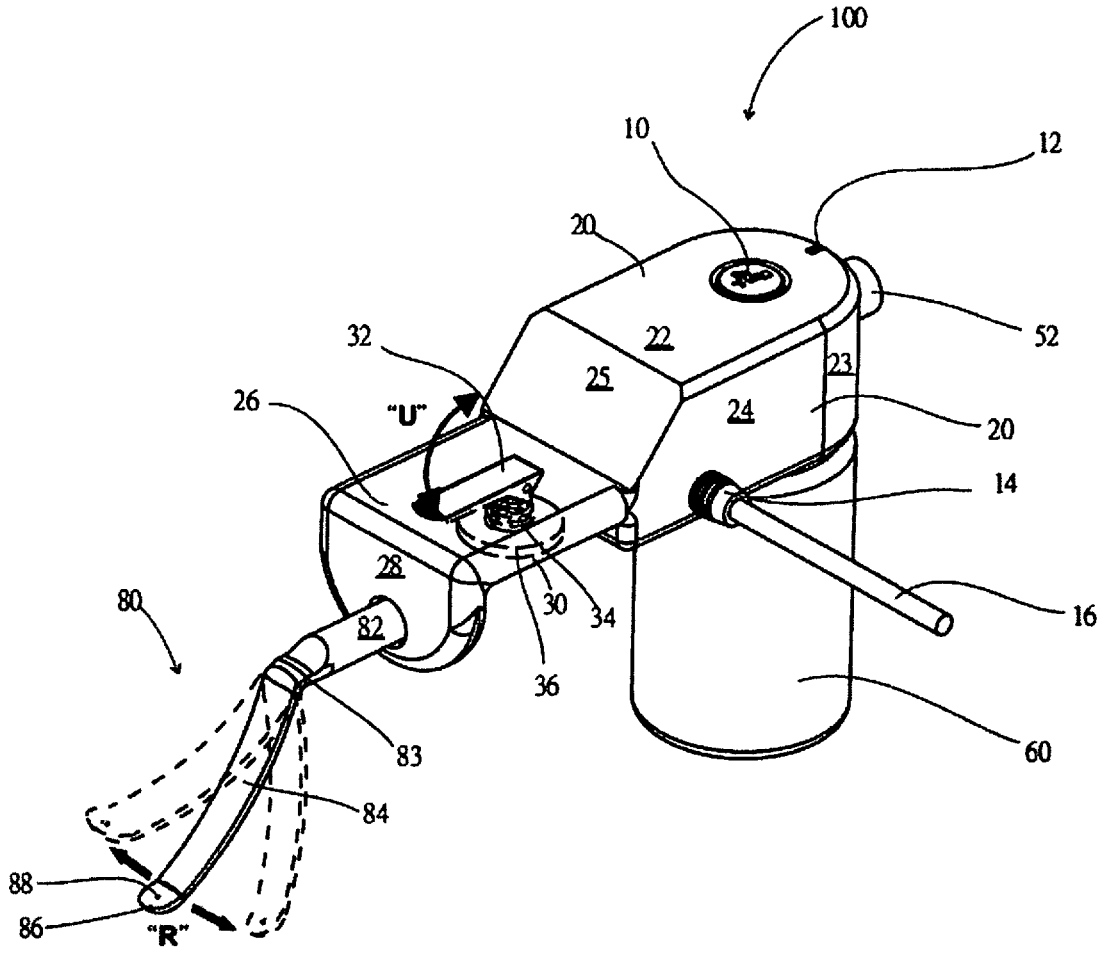
FIG. 1 is a perspective view of a washing and cleaning apparatus according to an embodiment of the invention.

FIG. 1 illustrates one embodiment of a wash and clean system 100, which generally includes a support body 20, an extended element 26 connected to the support body, a lip element 28 connected to the extended element 26, and a spray wand assembly 80 connected to the lip element 28 and adapted to deliver liquids onto a desirable area (e.g., a genital area) of a human body of a user.

The support body 20 of the wash and clean system 100 can be formed by one or more parts together into a support enclosure in order to contain therein various fluid channels, electric circuits (e.g., printed circuit boards (PCB)), motors, and combinations thereof, among others. In general, the support body 20 includes an upper portion 22, side walls 24, and a bottom portion (not shown). Optionally, the support body 20 further includes a back wall 23 and a front wall 25.

In one embodiment, the wash and clean system 100 may further include a power switch 10 such that various motors and electric circuits contained within the support body 20 can be turned on for powering up the apparatus and operating the wash, clean and other functions of the apparatus. The power switch 10 can be positioned, in one example, on top of the support body 20, such as on the upper portion 22 and be easily visible to a user. In addition, a power indicator 12 can be positioned on the support body 20 to indicate turning on of the electric power and proper functioning of the wash and clean system 100. In one example, the power indicator 12 can be positioned at or near a side of the upper portion 22 as shown in FIG. 1.

Figure 4:
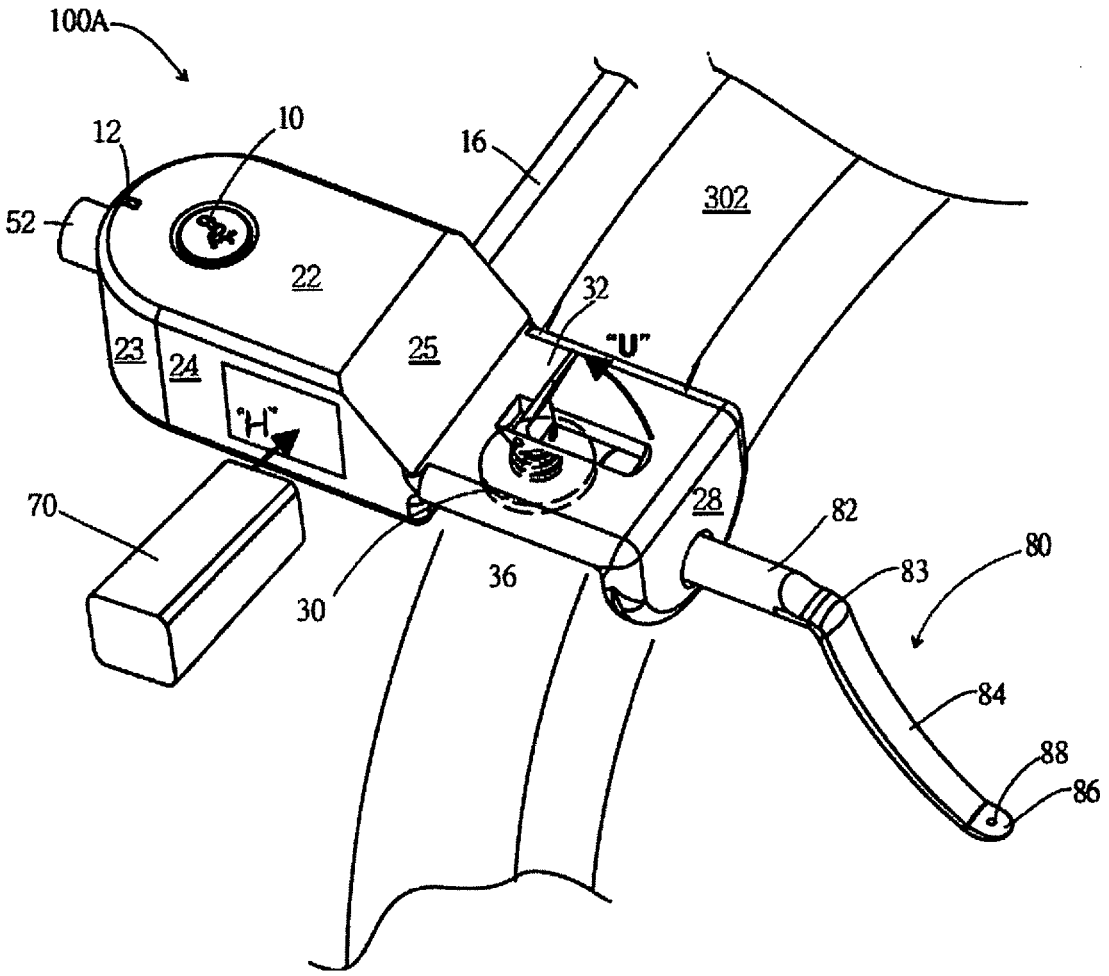
FIG. 4 is a perspective view of a washing and cleaning apparatus according to another embodiment of the invention.

In one aspect, the wash and clean system 100 is connected to a power cord 16 via a power connector 14, which is positioned on a part of the support body 20. In one example, the power cord 16 can be positioned at or near a side of the side walls 24 as shown in FIG. 1. The power cord 16 is adapted to connected to an electric outlet and provide electric power to power up the wash and clean system 100. In another aspect, the wash and clean system 100 is connected to a battery power pack 70 as shown in FIG. 4 and discussed below in order to conveniently power up the wash and clean system 100 without the need to find an electric outlet.

In another embodiment, the extended element 26 and the lip element 28 of the wash and clean system 100 are adapted to form into an L-shape clamp-like structure so as to be placed and mounted to a rim of a toilet bowl or an edge of a toilet seat. As a result, the wash and clean system 100 can be easily carried around by a user and can be adapted and secured onto a toilet for easy access to the bottom of the person for hygienic cleaning after using the toilet.

In one example, the extended element 26 includes a suction cup assembly 30 therein and a lever 32 on a surface of the extended element 26. The lever 32 is designed to be at an up position or a down position so as to press the suction cup assembly 30 and secure the extended element 26, and thus the whole unit of the wash and clean system 100 onto a rim of a toilet. The suction cup assembly 30 may include a spring 32 and a suction cup 34 being positioned, for example, at the bottom surface portion of the extended element 26, and functioning together to provide a suction force to a rim portion of a toilet.

As shown in FIG. 1, the spray wand assembly 80 of the wash and clean system 100 includes a distal end element 86 where a spray opening 88 is located. The spray wand assembly 80 further includes one or more liquid channels therein such that the liquids flowing therein can be delivered via the spray opening 88 and sprayed out. For example, the liquids can be sprayed out and onto a desirable area (e.g., a genital area, an anal area, anterior private parts, perianal region, etc.) of a human body while a human is using a toilet.

The spray opening 88 is adapted to spray out liquid in a stream or a mist form onto a desirable area of a human body. The shape and size of the spray opening 88 positioned at the tip of the distal end element 86 is not limited and can be a small opening, a multiple-holed nozzle type element, among others.

Suitable liquid that can be contained and flowed within the one or more channels of the spray wand assembly 80 include water, medication solutions, cleaning solutions and combinations thereof. The temperature of the liquids are not limited and may range from a cold water temperature to warm temperature of about 60° C.

Figure 3A:
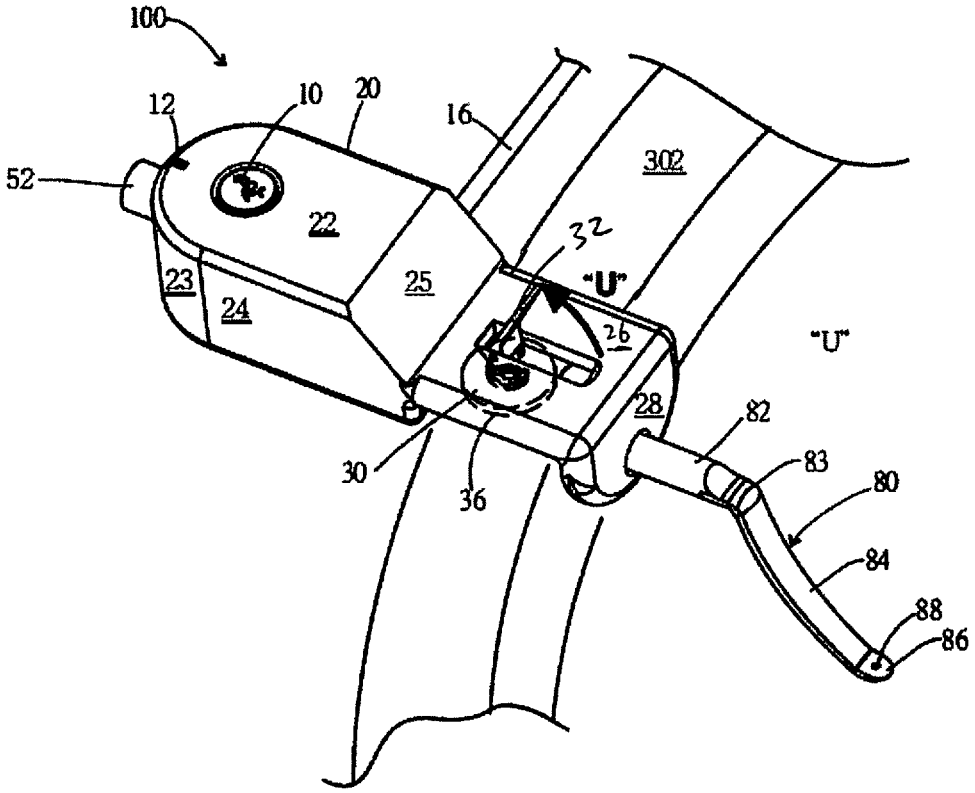
FIG. 3A is a front view of a washing and cleaning apparatus according to one embodiment of the invention.
Figure 3B:
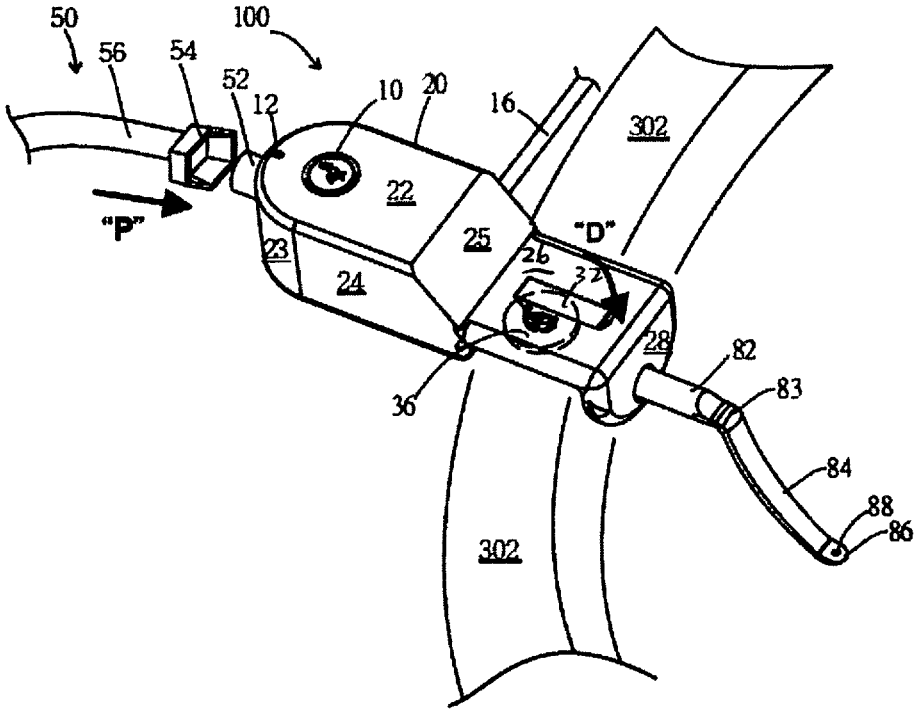
FIG. 3B is a front view of a washing and cleaning apparatus according to another embodiment of the invention.

In one embodiment, the support body 20 of the wash and clean system 100 includes a water inlet 52 adapted to connect to a water hose assembly (e.g., a water hose assembly 50 as shown in FIG. 3B) for supplying water and other liquid into the wash and clean system 100. For example, the water inlet 52 can be positioned near the back wall 23 of the support body 20.

In still another embodiment, the support body 20 of the wash and clean system 100 is connected to a canister assembly 60, which may include medication and/or cleanser solutions therein. Suitable medication and cleaning solutions are not limited and can be any of a desirable cleaning solution, a medication solution, a fragrant solution, a deodorant solution, a moisturizing solution, and/or combination thereof. In addition, the content of the liquid solutions within the canister assembly 60 can be changeable according to personal preference of a user or under the instruction of a doctor for treating various perineal or urinary tract infections, vaginal infections, and/or hemorrhoids, among others.

In operation, once the electric power is turned on and the motors within the support body 20 of the wash and clean system 100 are adapted to deliver all desirable liquids (e.g., water and liquid from a water hose assembly via the water inlet 52, a cleaning or medication liquid solution from the canister assembly 60, and combinations thereof) from one or more channels within the support body 20 through the extended elements 26, the lip element 28, to the spray wand assembly 80. The spray wand assembly 80 of the wash and clean system 100 also has one or more fluid channels therein for delivering liquids from the liquid channels within the lip element 28 onto the spray opening 88 on the distal end element 86.

As shown in FIG. 1, the spray wand assembly 80 generally includes a connector 83, an arm element 84, and the distal end element 86, where the connector 83 is adapted to rotate the arm element 84 such that the spray opening 88 on the distant end element 86 can be flexibly adjusted to be in close proximity to the desirable area of a human body. In addition, the spray wand assembly 80 further includes a rod element 82, where the connector 83 is adapted to connect the rod element 82 and the arm element 84.

Figure 2:
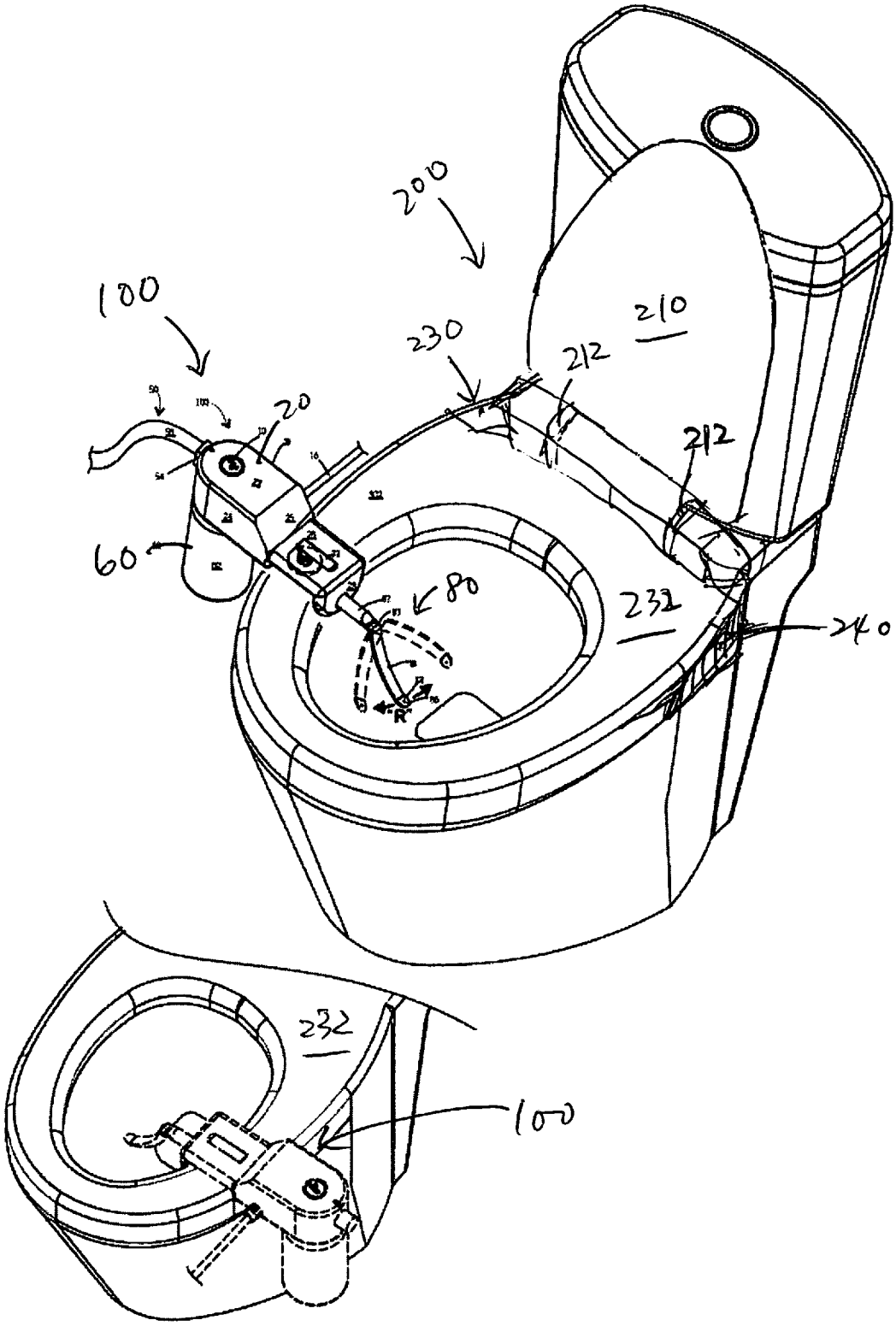
FIG. 2 is a perspective view of a washing and cleaning apparatus and a toilet seat apparatus according to one embodiment of the invention.

FIG. 2 is one example of the wash and clean system 100 being positioned and secured on a toilet seat apparatus 200 according to one embodiment of the invention. The toilet seat apparatus 200 generally includes a toilet seat cover 210, a toilet set 230, and a sear cover connector 212, connecting the toilet seat cover 210 with the toilet seat 230. In one example, the toilet seat apparatus 200 is a bidet system, which may include a base housing 220 for housing various parts for spray water and other liquids or solutions to clean a perianal area of a user using the toilet seat system.

Because most bidet systems have a water spray nozzle coming out from the base housing system 220 to clean a posterior portion (e.g., anal or perianal regions, etc.) of a human body, it is desirable to position a wash and clean system of the invention, such as the exemplary wash and clean system 100 onto the toilet seat apparatus 200 to clean the anterior or front area of a user, especially the private parts or vaginal area of a female or a person (male or female) who has a urinary tract infection and needs to wash and apply a medication solution onto an anterior private-part region. Alternatively, the wash and clean system 100 of the invention can be positioned and mounted to a conventional toilet seat without a pre-installed bidet system.

FIGS. 3A-3D illustrate a method of operating the wash and clean system 100 according to one or more embodiments of the invention. As shown in FIG. 3A, the wash and clean system 100 of the invention can initially be positioned and mounted to a seat rim 302 of a toilet seat. Then, a user (e.g., a female or male human being) can lift up the lever 20 in a direction marked as "U" so as to adjustably apply sufficient tension to the spring 34 and suction cup 36 of the suction cup assembly 30.

As shown in FIG. 3B, the user can next push down the lever 20 in a direction marked as "D" so as to compress the spring 34 and suction cup 36 of the suction cup assembly 30 and secure the wash and clean system 100 onto a portion of the seat rim 302. In addition, the user can easily attach the water hose assembly 50 in a direction "P" onto the water inlet 52 of the wash and clean system 100 for supplying water to the channels within the support body 20 of the wash and clean system 100. The water hose assembly 50 may include a water hose head 54, which may optionally include an on-off valve, and a long water hose 56 connected to a tap water outlet or other water source.

Next, optionally, the user can choose to supply additional liquid solutions (in addition to the water liquid provided from a water source from the water inlet 52) to the wash and clean system 100 by connecting the canister assembly 60 onto the support body 20 of the wash and clean system 100. For example, a user may hold the canister assembly 60 in an upright position with a liquid solution contained therein and move the canister assembly 60 in a direction "Z" to connect and secure the canister assembly 60 onto the support body 20.

Figure 3C:
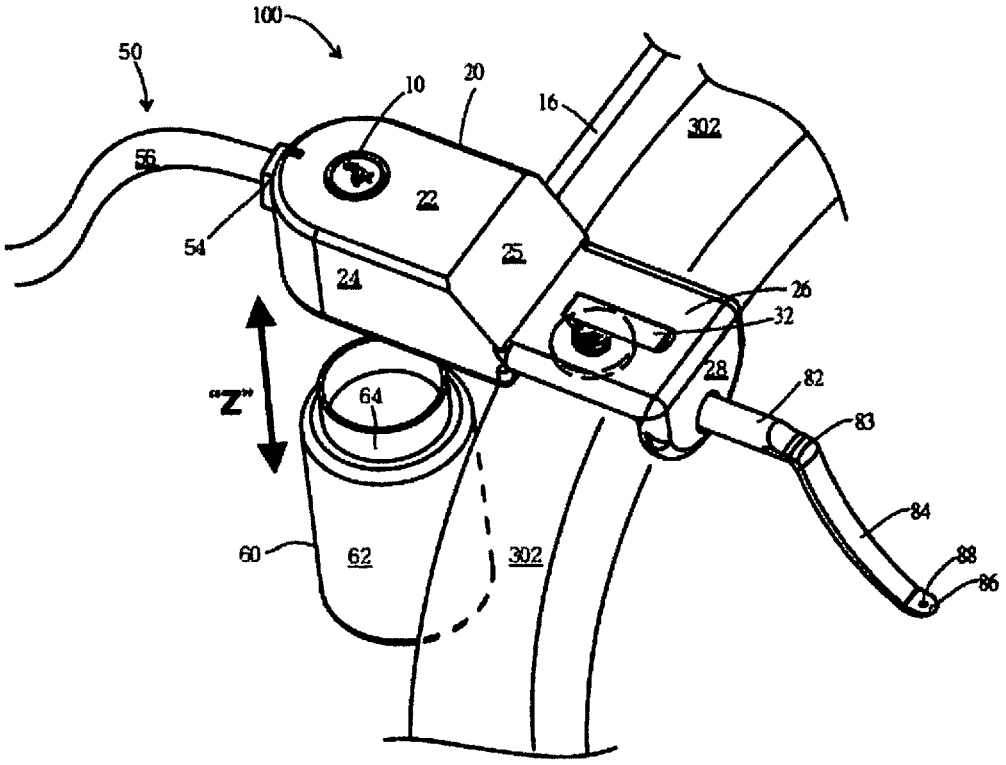
FIG. 3C is a front view of a washing and cleaning apparatus according to still another embodiment of the invention.

As shown in FIG. 3C, the canister assembly 60 may include a canister body 62 and a canister top 64. The canister top may be formed into a screw-like shape to be able to be turned and secured onto a bottom portion (not shown) of the support body 20. In one aspect, the canister body 62 of the canister assembly 60 is made of an insulation material so as to insulate and maintain the temperature of a liquid solution contained therein. Suitable insulation materials include stainless, plastics and other materials.

Figure 3D:
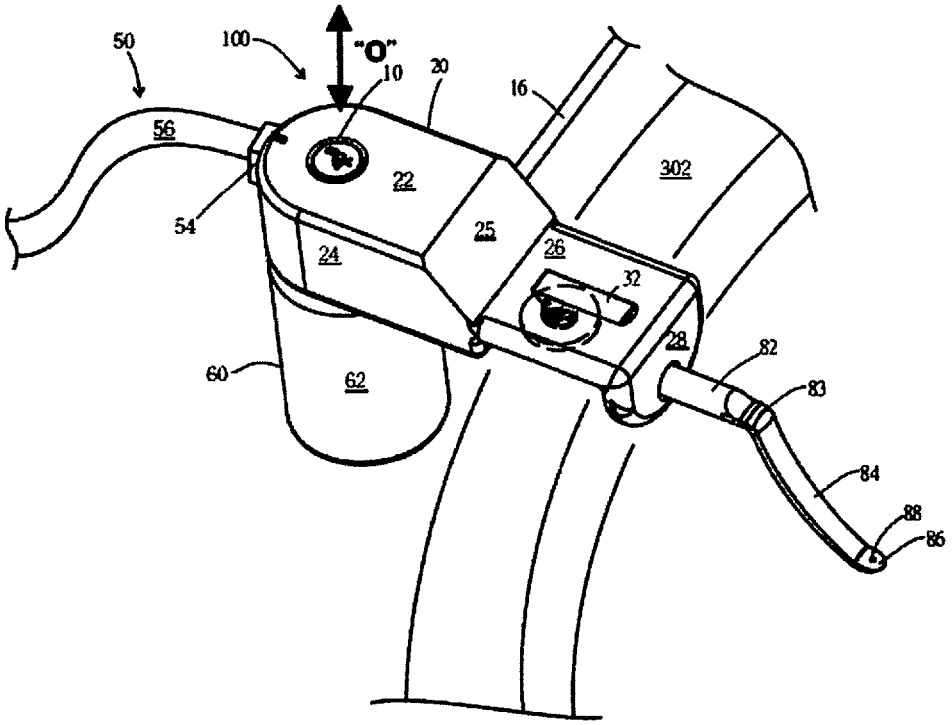
FIG. 3D is a front view of a washing and cleaning apparatus according to yet another embodiment of the invention.

FIG. 3D is a front view of the wash and clean system 100 operating according to one embodiment of the invention. As shown in FIG. 3D, once the wash and clean system 100 is secured and all necessary parts are properly connected to the auxiliary assemblies (e.g., the power cord 16, water hose assembly 50, the canister assembly 60, the user may turn on the electric power of the wash and clean system 100 by pushing the power switch 10, for example, in a direction "O" and start to operate and use the wash and clean system. The power switch 10 of the wash and clean system 100 may be controlled by electric circuits contained within the support body 20 and adapted to operate the flow of the liquids within the liquid channels of the wash and clean system 100 and spray liquids out of the spray opening 88 of the spray wand assembly 80.

Returning back to FIG. 1, during the operation of the wash and clean system by a user, the arm element 84 of the spray wand assembly 80 can be flexibly turned and/or rotated in a direction "T" by a user to a desirable "L" position or alternatively "R" position. Accordingly, the user is able to adjust the position of the arm element 84, thereby adjusting the spraying direction of the liquid sprayed out of the spray opening 88 so as to better wash and clean a specific area desirable to the user.

FIG. 4 shows a perspective view of the wash and clean system 100A that includes the battery power pack 70, thereby making the wash and clean system much more convenient and easily compatible with various toilet systems, without the need of an electric outlet nearby. A portable battery, such as the battery power pack 70 coupled to a side or a portion of the support body 20 can be used to provide electric power to turn on motors within the wash and clean system 100A and deliver liquids therein to the distal end element and spray liquids out of the spray opening 88.

Accordingly, a method and apparatus that is easy to carry, easily connected to auxiliary parts, and easy to install and use is provided for washing and cleaning a region of a human body. While the foregoing is directed to embodiments of the present invention, other and further embodiments of the invention may be devised without departing from the basic scope thereof, and the scope thereof is determined by the claims that follow.

The invention claimed is:

1. An apparatus for washing a region of a human body, comprising:

a support housing;

an intermediate support member connected to the support housing;

a lip element connected to the intermediate support member, such that the intermediate support member is disposed between the support housing and the lip element so as to affix the apparatus to a toilet seat or toilet rim; and a spray wand assembly connected to the lip element and adapted to deliver liquid with one or more liquid channels therein, the spray wand assembly including a rod with a first end connected to the lip element and a second end connected to a downwardly extended arm, wherein the downwardly extended arm is pivotable with respect to the lip element via the rod and the downwardly extended arm having a distal end where a spray opening is located.

2. The apparatus of claim 1, wherein the rod further comprises a connector that is adapted to move the downwardly extended arm.

3. The apparatus of claim 1, further comprising a power indicator and a power switch.

4. The apparatus of claim 1, wherein the support housing body comprises a water inlet that is adapted to be connected to a water hose assembly.

5. The apparatus of claim 1, wherein the support housing is connected to a power cord.

6. The apparatus of claim 1, wherein the support housing is connected to a battery power pack.

7. The apparatus of claim 1, wherein the support housing is connected to a canister assembly.

8. The apparatus of claim 1, wherein the intermediate support member comprises a lever.

9. The apparatus of claim 1, wherein the intermediate support member comprises a suction cup assembly therein.

10. The apparatus of claim 1, wherein the rod comprises a connector that rotates the downwardly extended arm such that the spray opening on the distal end is flexibly adjustable to be in close proximity to the region of the human body during use of the spray wand assembly.

11. The apparatus of claim 1, wherein the downwardly extended arm is curved.

12. The apparatus of claim 10, wherein the downwardly extended arm is connected to the distal endelement.

13. The apparatus of claim 1, wherein the support housing is connected to a power mechanism.

14. The apparatus of claim 1, wherein the support housing is connected to a canister assembly with medication or cleaner solutions therein.

15. The apparatus of claim 1, wherein the support housing comprises a water inlet adapted to be connected to a water hose assembly for supplying water and at least one of a medication solution, a cleaning solution, a fragrant solution, a deodorant solution, a moisturizing solution or combinations thereof into the apparatus.

16. An apparatus for washing a region of a human body, comprising:

a support housing;

an intermediate support member connected to the support housing body;

a lip element connected to the intermediate support member, such that the intermediate support member is disposed between the support housing and the lip element so as to affix the apparatus to a toilet seat or toilet rim;

a spray wand assembly connected to the lip element and adapted to deliver liquid with one or more liquid channels therein, the spray wand assembly including a rod with a first end connected to the lip element and a second end connected to a downwardly extended arm, wherein the downwardly extended arm is pivotable with respect to the lip element via the rod and the downwardly extended arm having a distal end where a spray opening is located;

a power switch;

and a power indicator.

17. The apparatus of claim 16, wherein the support housing comprises a water inlet that is adapted to be connected to a water hose assembly.

18. The apparatus of claim 16, wherein the extended element intermediate support member comprises a lever and a suction cup assembly therein.

19. The apparatus of claim 16, wherein the rod further comprises a connector and the downwardly extended arm pivotably moves via the connector.

20. An apparatus for washing a region of a human body, comprising:

a support housing, wherein the support housing comprises a water inlet that is adapted to be connected to a water hose assembly;

an intermediate support member connected to the support housing;

a lip element connected to the intermediate support member, such that the intermediate support member is disposed between the support housing and the lip element so as to affix the apparatus to a toilet seat or toilet rim; and a spray wand assembly connected to the lip element and adapted to deliver liquid with one or more liquid channels therein, the spray wand assembly including a rod with a first end connected to the lip element and a second end connected to a downwardly extended arm, wherein the downwardly extended arm is pivotable with respect to the lip element via the rod and the downwardly extended arm having a distal end where a spray opening is located.

* * * * *